United States Patent [19]

Olsen

[11] 4,324,085

[45] Apr. 13, 1982

[54] CARRIER ASSEMBLY APPARATUS

[75] Inventor: Robert C. Olsen, Streamwood, Ill.

[73] Assignee: Illinois Tool Works Inc., Chicago, Ill.

[21] Appl. No.: 140,068

[22] Filed: Apr. 14, 1980

[51] Int. Cl.[3] ..... B65B 27/04; B65B 21/00

[52] U.S. Cl. ..... 53/48; 53/556

[58] Field of Search ..... 53/48, 580, 582, 585, 53/556

[56] References Cited

U.S. PATENT DOCUMENTS

| | | | |
|---|---|---|---|
| 3,430,412 | 3/1969 | Currie, Jr. | 53/48 |
| 3,775,935 | 12/1973 | Schlueter et al. | 53/48 |
| 3,816,968 | 6/1974 | Morgan et al. | 53/48 |
| 3,959,949 | 6/1976 | Benno et al. | 53/48 X |
| 4,018,027 | 4/1977 | Curry et al. | 53/48 |
| 4,079,571 | 3/1978 | Schlueter et al. | 53/48 |
| 4,250,682 | 2/1981 | Braun | 53/48 |

*Primary Examiner*—Horace M. Culver

*Attorney, Agent, or Firm*—Thomas W. Buckman

[57] ABSTRACT

An apparatus for assembling a plurality of containers into packages which includes a drum assembly with a plurality of jaw stations each including stretching fingers and tab devices laterally outside of the stretching fingers for associating with a forming bar at the entry region of the drum, which combination efficiently and reliably deforms the outer band of a continuously fed carrier strip to properly mate with the laterally outer surfaces of the stretching jaws.

4 Claims, 5 Drawing Figures

CARRIER ASSEMBLY APPARATUS

BACKGROUND OF THE INVENTION

Drum assemblies of the type generally described herein are typically those shown in U.S. Pat. Nos. 3,816,968 or 4,079,571. They will include a plurality of jaw stations circumferentially spaced about spider wheels which form the lateral dimensions of the drum. Each jaw station will include at least one stretching jaw which is movable outwardly relative to the center line of the machine. The jaw is configured to include fingers or jaw elements generally arcuate in configuration which will register around a can after the carrier has been stretched permitting the carrier to be snapped over and beneath the chime sections of the can.

The carrier strip is a relatively thin, flat configuration having the plurality of container encircling bands formed therein. The outermost band of the carrier strip must be deformed to a position substantially 90° to the plane of the carrier strip in order to be properly fitted about the stretching fingers for subsequent association with the containers.

In the prior art, machines of the type mentioned above, a carrier guide and forming station includes twisting rails which bend the outer band of the carrier strip into its proper orientation prior to association with the continuously moving sets of jaw stations. For example, reference to U.S. Pat. No. 3,775,935 and also to U.S. Pat. No. 3,959,949, will show a guide assembly which includes a pair of laterally spaced carrier forming rails which include juxtaposed surfaces associated about and beneath the side marginal regions of the carrier strip. A first section of the marginal twisting rails in the prior art guide assemblies arranges the juxtaposed surfaces of the rails in a planar condition parallel to the strip. A second section of these surfaces gradually deforms the side margins of the strip by bending the juxtaposed flat rails to a position 90° to the first position, thus the carrier strip is forced into a conforming relationship with the jaws by bending the outer margins 90° to the remaining portions of the strip. When the carrier is thus in this deformed condition, it is then associated with the jaws which are continuously moving beneath the guide regions.

SUMMARY OF THE INVENTION

In contra-distinction to the above-noted prior art multi-packaging machines and methods for applying a strip of carrier devices, the machine and method described herein includes a particular jaw configuration which cooperates with simple, straight forming rails to positively and efficiently deform the outer marginal bands of the strip into proper package making configuration on the jaws.

Each of the jaw stations include a pair of jaws adapted to move laterally of the drum relative to each other with each of the pair including carrier stretching fingers and a ramp structure extending laterally outwardly of each of the stretching finger means. The guide assembly for receiving a continuous reel or strip of carrier and feeding onto a continuously rotating drum is similar in many respects to the guide assembly of the prior art with one important distinction. The twisting rails for deforming the outer margins of the strip into a 90° relationship with the remainder of the strip prior to association with the drum is eliminated in this invention. A simpler, more efficient and positive configuration for deforming the band of this invention includes substantially straight tucking or wedging rails which co-act with the unique configuration of each of the jaws to gradually force the outer margin of the strip downwardly relative to the remaining portions of the strip and against the ramp section of the jaw which effects a twisting of the outer band of the strip. Thus, as the carrier is fed onto the drum, each outer marginal region is gradually forced down into a recess and twisted individually by the co-action of the ramp and the tucking or wedging rail.

A further aspect of the invention is the use of spaced stretching fingers which in composite generally conform to the arcuate configuration of the containers but are of a larger radius than that of the containers. This larger radius provides sufficient clearance between the jaws of containers as they are moved at high speeds relative to one another and thus provides tolerances for an otherwise highly critical timing necessary between the drum and containers to be packaged.

Thus, a primary object of the invention is to provide a simplified apparatus for positively deforming the side marginal bands of the carrier strip onto the stretching surfaces of associated jaw stations.

Other objects and features of the invention will become apparent upon a perusal of the hereinafter following detailed description read in conjunction with the drawings.

DETAILED DESCRIPTION OF THE PREFERRED EMBODIMENT

A complete machine for assembling containers and carriers of the type generally described herein need not be described in this specification. However, for a detailed description of such a machine, reference is made to U.S. Pat. No. 3,775,935 and U.S. Ser. No. 59,019 now U.S. Pat. No. 4,250,682, which generally show a drum type of applicating machine for continuously applying endless strips of resilient plastic container device material to a plurality of rows of containers.

Figure 1:
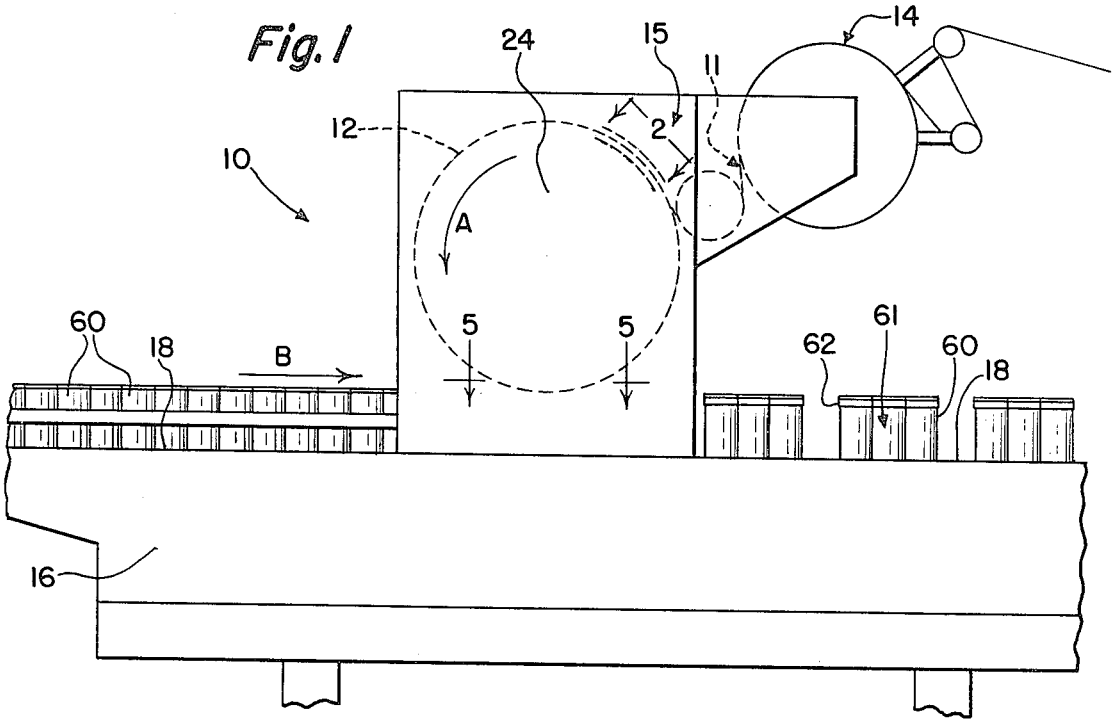
FIG. 1 is a fragmentary side elevational view of a machine embodying the invention.
Figure 3:
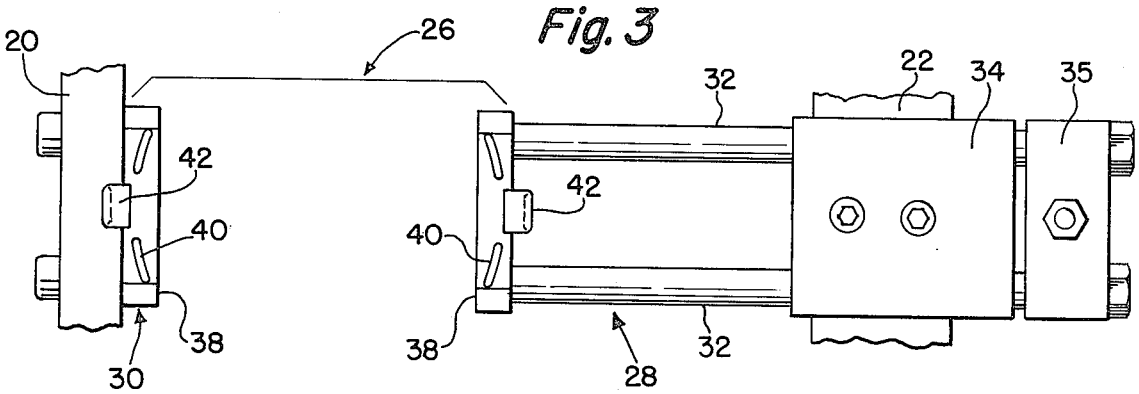
FIG. 3 is an enlarged top plan view of a jaw station incorporated in the present invention.

A typical drum type applicating machine shown generally in FIG. 1 as apparatus 10 will include a drum assembly 12 rotating about a fixed axis 24. As will become apparent with reference to the aforementioned patents and the below description, each drum will have a plurality of jaw stations circumferentially spaced about its periphery. A carrier strip 11, which includes a plurality of severable carrier devices each including a longitudinally extending series of transversely arranged ranks of container encircling bands, is continuously fed from a reel arrangement 14 into a guide and forming section 15 at the entry region of the drum assembly. As is typical in machines of this type, the drum assembly 12 rotates in the direction of the arrow A shown in FIG. 1 while the plurality of rows of containers continuously move on the conveyor 18 in the direction of the arrow B into the package making area of the machine directly beneath the drum 12. Thus, a plurality of discrete containers 60, moving in a plurality of laterally aligned rows, results in a package 61, which includes the containers and a resilient container encircling band device 62 positioned beneath the chimes of the can.

As in applicating machines of the type noted above, this invention includes jaw stations 26 each including a pair of opposing jaw members 38. Each jaw member 38 thus being adapted to be inserted into respective apertures in the carrier strip so that they abut the inner edge of the laterally outer bands in the strip to stretch the strip laterally by movement of one or both of the jaw members 38. In the preferred embodiment, only one such jaw member 28 is designed to move relative to the drum while opposing jaw member 30 is designed to be fixed relative to the drum. A pair of laterally spaced spider members 20,22 are fixed to rotate about the axis 24 with the associated jaw stations secured thereto. Fixed jaw member 30 is thus secured to a spider 20 while movable jaw station 28 is mounted to spider 22. This fixed and stationary jaw station is described in more detail in the U.S. Application, Ser. No. 59,019 now U.S. Pat. No. 4,250,682 and does not in itself form part of the invention herein described. This invention, however, is directed to an improvement in the configuration of the jaw members per se and the interaction of the improved jaw configuration with forming means to efficiently bend the outer bands of the carrier strip into a proper relationship with the stretching jaw members.

For example, the improvement is directed to the guide area 15 of the apparatus. Each fixed jaw will include a pair of spaced finger members 40, preferably lying in an arcuate configuration. Each jaw member 38 further includes a ramp member 42 extending upwardly and outwardly from the base of the jaw so that it creates a trough between the outermost region of the fingers 40 and the ramp itself. A guide device 34 is secured to the periphery of the spider 22 with passages formed therein permitting free sliding movement of rod members 32 which are fixed to the movable jaw 38. The other extremity of the rods 32 are fixed to a cam follower 36 and cam follower carrier 35 which is associated with a cam track as is generally shown in the above-mentioned prior art. As the drum rotates in the directions shown in FIG. 1, the cam track and cam follower arrangement gradually opens the jaw stations laterally outwardly relative to one another so that the carrier strip is progressively stretched laterally.

In order to insure that the can receiving bands of the carrier are properly positioned, it is important that the outer band regions 64 of the carrier strip be deformed or twisted 90° from the plane of the strip. This deformation of the carrier strip is positively created in an effective and efficient manner by cooperation of the ramps 42 on each of the jaw stations and forming bars 50 which act as a wedge forcing the outer bands 64 into conforming relationship with the inclined ramps 42.

Each and every jaw station reacts with a simple, straight bar to deform or twist the outer bands. The carrier strip 11 is fed into a guide system which includes a generally U-shaped tray 44 with a cover or holddown plate 46. This portion of the guide system of this invention is similar to the prior art, however, in contra-distinction to the prior art, the strip exits from this initial guide system and into a secondary forming guide system which acts in cooperation with each and every station moving beneath it. This secondary guide section includes stationary side rail extensions 48 which may be secured to the side rails of the U-shaped trough and which in turn carry a pair of laterally spaced carrier band deforming bars 50. Each of these deforming bars is generally straight and spaced inwardly of the adjacent support bars 48 so as to be directly aligned with the path of movement of the jaw stations rotating therebeneath. For example, in the embodiment described herein, the leftmost forming bar 50 in FIG. 2 will be directly parallel to the plan of the spider 20 and directly aligned with the gap or recess created outside of the fingers 40 by the ramp 42. Likewise, the rightmost forming rail 50 is directly aligned with the path of movement of the moving jaws 28. However, it should be understood that depending on the rate of movement of the moving jaws 28 from their respective stationary jaw 30, the rightmost forming rail 50 may be disposed at an acute angle (not shown) to the plane of rotation of the drum so that the rightmost forming bar may directly follow the path of the ramps 42. In order to insure stability of the operation, a lowermost back-up plate 54 is designed to cantilever-extend from the tray 44 and a plurality of hold-down fingers 52 are designed to restrain the upward movement of the carrier strip 11 relative to the back-up plate 54, much in the manner of the operation of the hold-down plate 46 relative to the tray 44 at the first part of the guide system of this invention.

Figure 4:
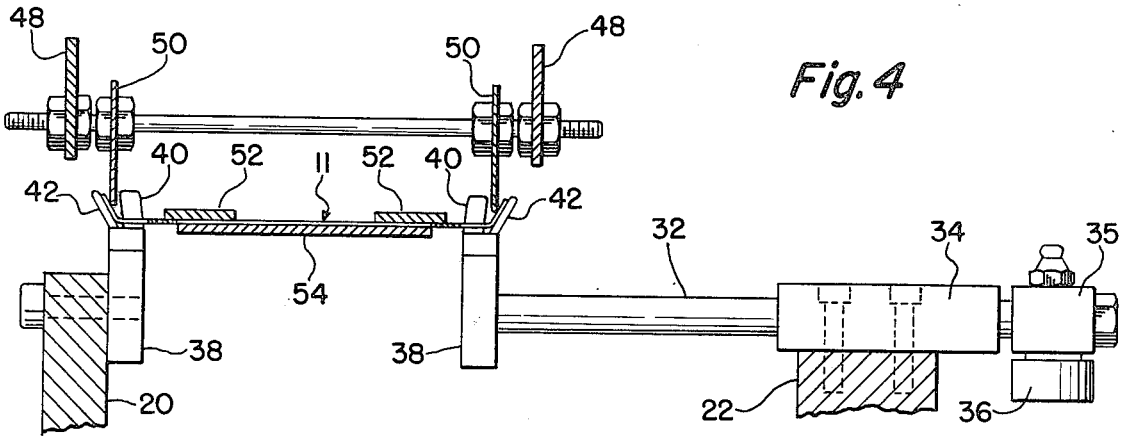
FIG. 4 is a cross-sectional view of the guide section of the apparatus as taken in a direction of Lines 4—4 of FIG. 2.

In operation, therefore, and as more clearly shown in FIG. 4, the carrier strip will be fed out of the first guide section so that the outermost band 64 directly overlies the jaw stations 28, 30, and most particularly are aligned with the ramps 42 so that the forming bars 50 are spaced laterally inwardly from the uppermost extremity of the ramps 42 as well as the outermost lateral extremity of the strips. As the strip and jaw stations are moved in the direction of rotation of the drum, the depth of the penetration of the forming bars 50 gradually increases so that its entry into the recess formed between the ramp 42 and the fingers 40 increases to carefully and firmly deform the side bands 64 in a manner shown in FIG. 4 so that, as the stretching members or fingers 40 are slowly laterally moved relative to one another, the side bands assume a proper position for application and further stretching of the carrier strip.

Figures 2, 5:
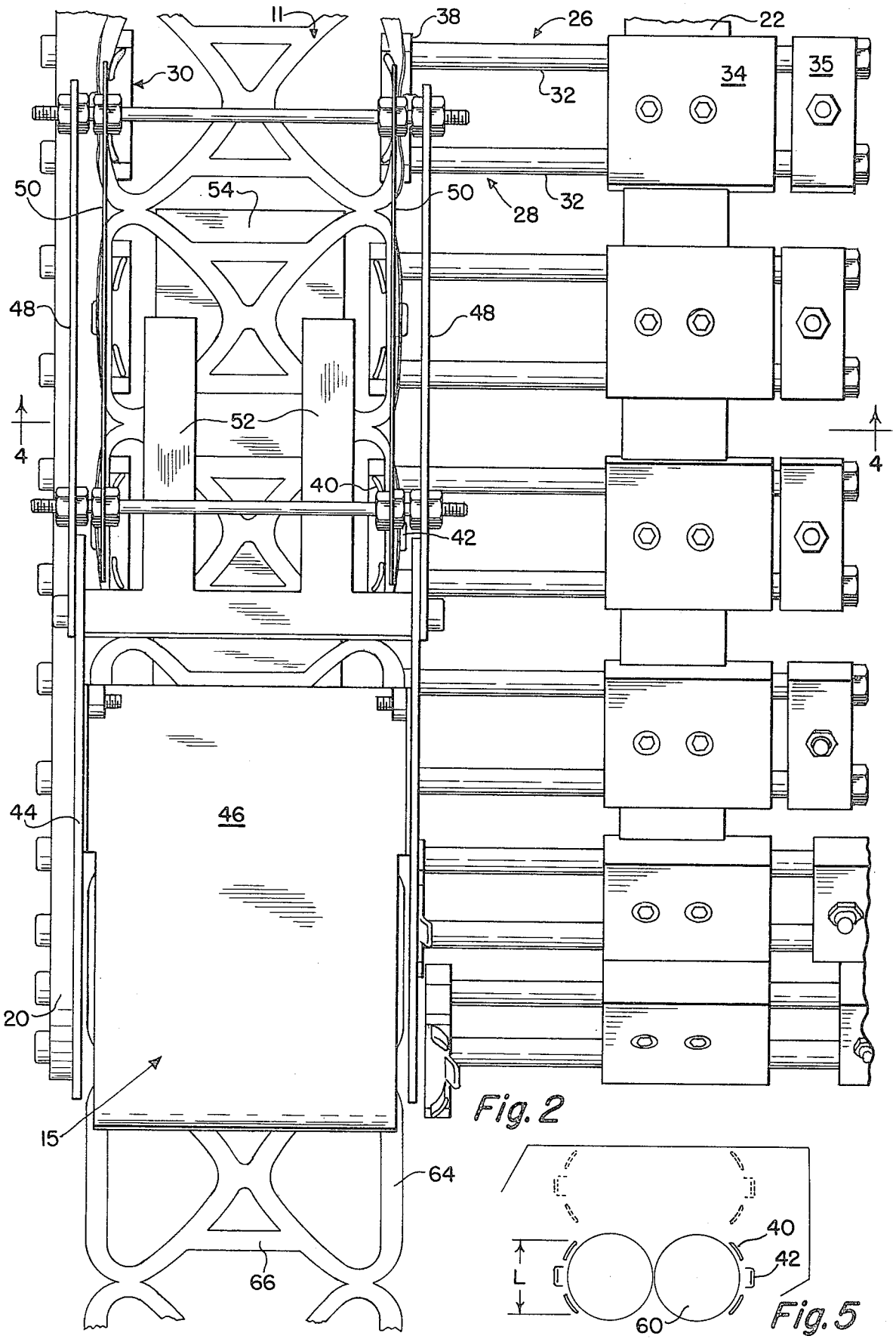
FIG. 2 is a fragmentary enlarged elevational view of the guide section of the machine such as taken in a direction of Lines 2—2 of FIG. 1.
FIG. 5 is a fragmentary plan view as taken in the direction of Lines 5—5 of FIG. 1 of a package making station of the invention.

A further important aspect of the invention is the radius of the arc upon which the forming fingers 40 lie. In prior art devices, the radius of the carrier stretching jaws was generally conforming to the radius of the cans or the can chime. In this invention, however, it has been found that a slightly increased radius of the jaw fingers 40 relative to the cans provides improved results. Such a relationship is schematically shown in FIG. 5. While not shown in the application, it is within the scope of this invention to provide forming fingers 40 which are straight or lie in a common plane rather than the generally arcuate configuration or obtuse angle configuration that is shown throughout the drawings herein. With the increased radius of the forming fingers 40, as well as possibly a decrease in the total length L, more potential clearance is obtained between the rotating jaws and moving cans. In high speed operations, timing and tolerances are important and this increased clearance potential is, therefore, an aid to achieving high efficiencies.

Having described the invention, it is to be understood that changes can be made in the present embodiment by one skilled in the art within the scope of the hereinafter following claims.

What is claimed is:

1. In an apparatus for assembling a plurality of containers into packages by utilizing carrier stock of resilient plastic material comprising a longitudinally extending series of transversely arranged ranks of container encircling bands which are adapted to be transversely stretched for application to successive ranks of a plurality of rows of said containers, a rotating drum assembly for receiving the carrier stock, laterally stretching and applying said carrier stock to said containers, the drum assembly comprising a pair of spider wheels mounted in parallel spaced apart relationship for rotation about a horizontal axis above the plurality of rows of containers, a plurality of jaw stations mounted in parallel, side-by-side relationship circumferentially about the drum assembly, each jaw station including a pair of opposing carrier stretching and band forming jaws, the improvement comprising each jaw including laterally inner and outer sections, each inner section including a pair of spaced upstanding finger means for association with the inner periphery of each laterally outermost band in the series of container encircling bands to stretch the stock laterally, and each outer section including a ramp means extending upwardly and outwardly from the base of the finger means, the ramp means located directly adjacent and laterally opposing the space between the fingers, the topmost regions of the inner and outer sections being spaced a predetermined, limited distance so as to twist the outermost band as it becomes associated with each jaw between said inner and outer sections, the apparatus further including carrier stock guide means located above one segment of the periphery of the rotating drum adjacent and substantially immediately following the portion of the drum which initially receives the carrier stock, the guide means including a pair of laterally spaced bars of limited thickness, the bars arranged so as to be aligned with the pair of opposing carrier stretching and band forming jaws with each bar located so its thickness dimension is totally confined within the predetermined limited distance defined by the topmost regions of the inner and outer sections, the guide means further arranged to vary in spacing between the lower edge of the bar and the jaws with an entering region being spaced slightly upwardly from the topmost regions of the jaws to an exiting region wherein the lower edge of the bar is spaced downwardly from the topmost regions and within the recess formed between the inner and outer sections so that the outermost band is twisted generally 90° from its original condition.

2. The apparatus of claim 1, wherein the finger means are generally arcuate.

3. The apparatus of claim 1, wherein the finger means include a pair of spaced upstanding fingers each of said fingers being arcuate and located along an arc of a circle of predetermined diameter, said predetermined diameter being greater than the diameter of the container in the region of resilient association with the container encircling band.

4. The apparatus of claim 1, wherein at least the plurality of jaw stations associated with one of said pair of spider wheels is mounted for reciprocating linear movement in directions generally parallel to the horizontal axis, the bar associated with the movable jaw stations diverging outwardly to remain aligned over the jaws as they rotate and move outwardly.

* * * * *